US007640938B2

(12) United States Patent
Okajima et al.

(10) Patent No.: US 7,640,938 B2
(45) Date of Patent: Jan. 5, 2010

(54) MASCARA APPLICATOR

(75) Inventors: Takao Okajima, Tokyo (JP); Susumu Fujinami, Tokyo (JP)

(73) Assignee: Kao Corporation, Tokyo (JP)

( * ) Notice: Subject to any disclaimer, the term of this patent is extended or adjusted under 35 U.S.C. 154(b) by 551 days.

(21) Appl. No.: 10/553,988

(22) PCT Filed: Apr. 20, 2004

(86) PCT No.: PCT/JP2004/005640

§ 371 (c)(1),
(2), (4) Date: Aug. 24, 2006

(87) PCT Pub. No.: WO2004/093597

PCT Pub. Date: Nov. 4, 2004

(65) Prior Publication Data

US 2007/0000511 A1 Jan. 4, 2007

(30) Foreign Application Priority Data

Apr. 21, 2003 (JP) ..... 2003-116378

(51) Int. Cl.
*A45D 2/48* (2006.01)
*A45D 40/26* (2006.01)

(52) U.S. Cl. ..... 132/217; 132/218

(58) Field of Classification Search ..... 132/217, 132/218, 216

See application file for complete search history.

(56) References Cited

U.S. PATENT DOCUMENTS

| | | | | |
|---|---|---|---|---|
| 2,630,516 | A * | 3/1953 | Rausch et al. | 132/217 |
| 5,155,199 | A * | 10/1992 | Hayashi | 528/65 |
| 5,307,826 | A * | 5/1994 | Iosilevich | 132/218 |
| 6,105,585 | A | 8/2000 | Thomas | |
| 2005/0244353 | A1 * | 11/2005 | Lendlein et al. | 424/70.1 |

FOREIGN PATENT DOCUMENTS

| | | |
|---|---|---|
| JP | 63-91201 | 6/1988 |
| JP | 2-148602 | 12/1990 |
| JP | 9-173130 | 7/1997 |
| JP | 10-167936 | 6/1998 |
| JP | 10-192037 | 7/1998 |
| JP | 2002-28020 | 1/2002 |
| JP | 2002-121119 | 4/2002 |
| JP | 2003-55158 | 2/2003 |
| JP | 2004-121535 | 4/2004 |
| WO | WO 02/01499 A2 | 1/2002 |

* cited by examiner

*Primary Examiner*—Robyn Doan
(74) *Attorney, Agent, or Firm*—Oblon, Spivak, McClelland, Maier & Neustadt, L.L.P.

(57) ABSTRACT

A mascara applicator integrally contains curling means (2) for holding eyelashes to curl the eyelashes into a certain shape, mascara adhering means (3) for adhering a mascara agent to the eyelashes, and mascara supplying means (4) for supplying the mascara agent to the mascara adhering means (3).

14 Claims, 8 Drawing Sheets

MASCARA APPLICATOR

TECHNICAL FIELD

The present invention relates to a mascara applicator for applying a mascara agent to eyelashes.

BACKGROUND ART

Conventionally, in a mainstream mascara product for making eyelashes look well-shaped and beautiful, a liquid type or cream type mascara agent is applied to eyelashes by a brush or the like. The application of the mascara agent to the eyelashes is carried out by either holding the eyelashes with a holding type curler (an eyelash curler) for physically curling (shaping) or thermally shaping the eyelashes with an electric heating type curler for curling, and subsequently applying the mascara agent to the eyelashes by use of a brush. The above holding type curler has been disclosed in, for example, Japanese Patent Laid-Open Publication No. Hei 9-173130, and the above electric heating type curler has been disclosed in, for example, Japanese Patent Laid-Open Publication Nos. 2002-28020 and Hei 10-192037.

However, if an attempt is made to physically curl eyelashes by use of the holding type curler, the eyelashes do not curl well, especially just after waking up or in a humid condition such as a rainy day. In addition, if the operations are repeated, the eyelashes are damaged, cut, and fall out, thus causing problems. Although curling itself is relatively easy if the electric heating type curler is used, a mascara agent must be applied to eyelashes by a brush thereafter, thus the operational complexity has not been improved.

Conventionally, a mascara agent is applied separately after the curling operation, as described above. In addition, the application operation must be repeated many times, making the operation complicated. In some cases, the shape of the eyelashes is again adjusted by use of a curler after applying the mascara agent. In this case, a coating formed on the eyelashes is damaged, and the mascara agent applied to the eyelashes tends to be smeared off by tears or the like. Moreover, since a mascara agent is applied by use of a brush or the like, uniform application is hard to be achieved, and clumps tend to be formed. Further, the application is repeated many times for achieving a volume enhancing effect, but the weight of the mascara agent itself may cause curling down. Therefore, the curling effect after the mascara application does not last.

DISCLOSURE OF THE INVENTION

Accordingly, an object of the present invention is to provide a mascara applicator in which the curling of eyelashes and the application of a mascara agent to the eyelashes can be performed easily and simultaneously, and in which the mascara agent applied to the eyelashes is smear-proof and clump-free, and has a long lasting curling effect.

The above object has been achieved according to the present invention by providing a mascara applicator integrally having curling means for holding eyelashes to curl the eyelashes into a certain shape, mascara adhering means for adhering a mascara agent to the eyelashes, and mascara supplying means for supplying the mascara agent to the mascara adhering means.

DETAILED DESCRIPTION OF THE INVENTION

A preferred embodiment (a first embodiment) of the mascara applicator of the present invention will be described below with reference to the drawings.

Figure 1A:
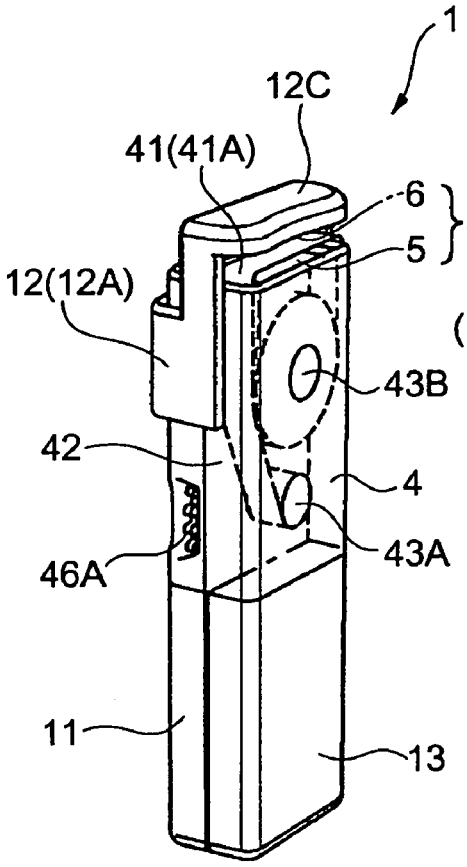
FIG. 1(*a*) and FIG. 1(*b*) are front perspective views showing a mascara applicator of a first embodiment of the present invention, wherein FIG. 1(*a*) is a view showing a state in which a film case accommodating film-shaped mascara is attached, and FIG. 1(*b*) is a view showing a state in which the film case is removed.
Figure 1B:
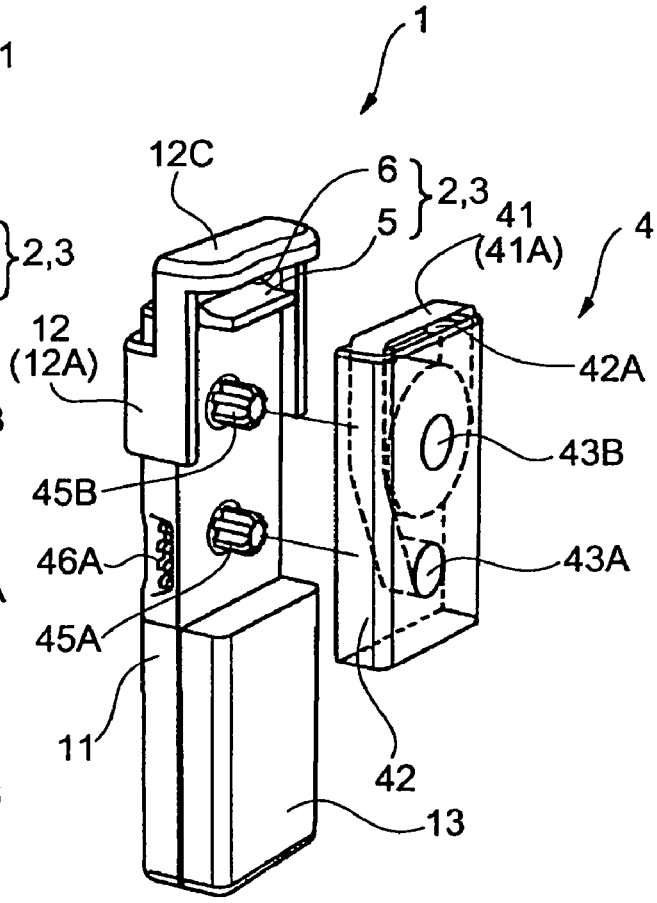
Figure 2:
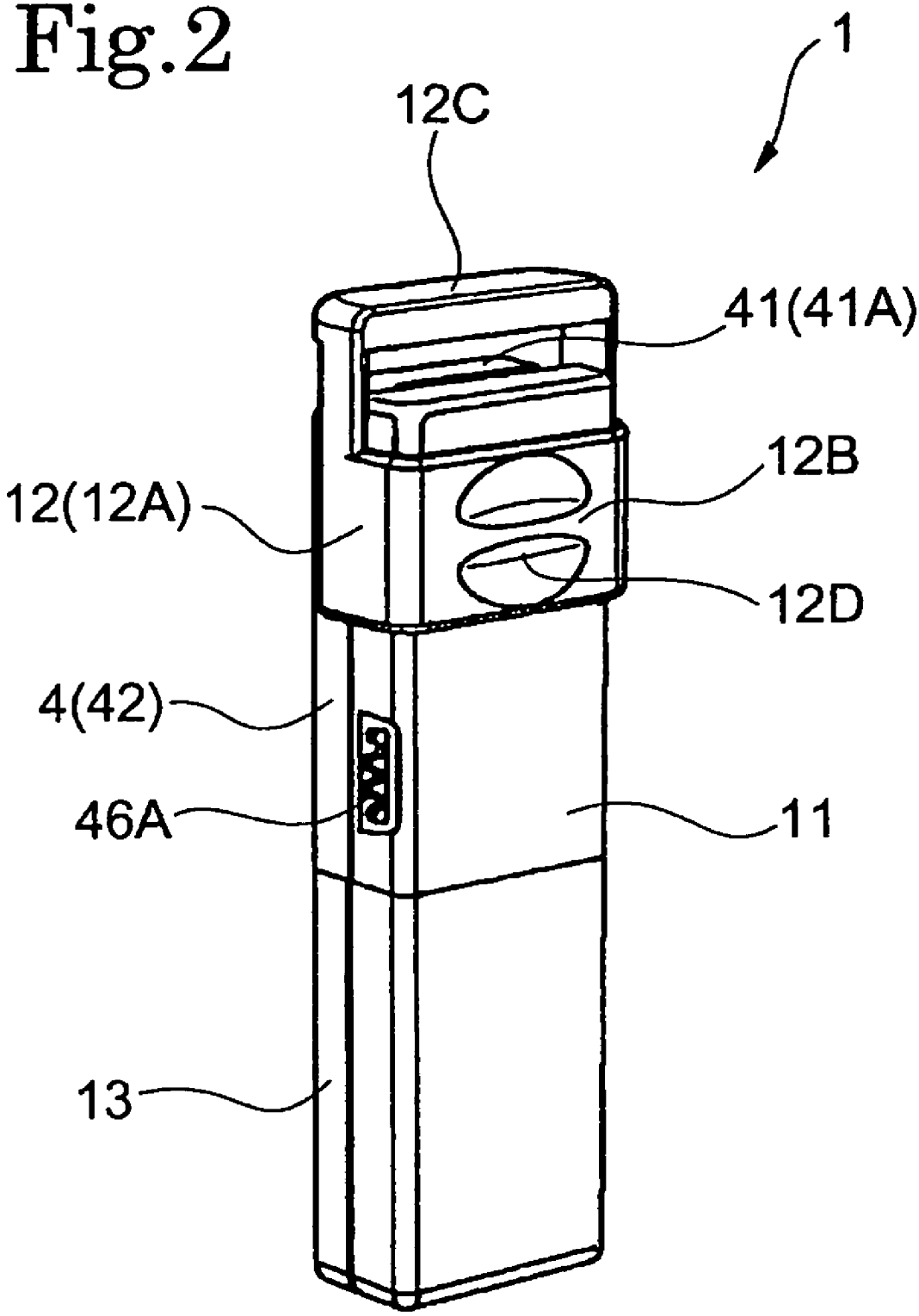
FIG. 2 is a rear perspective view showing the mascara applicator of the first embodiment of the present invention.
Figure 7A:
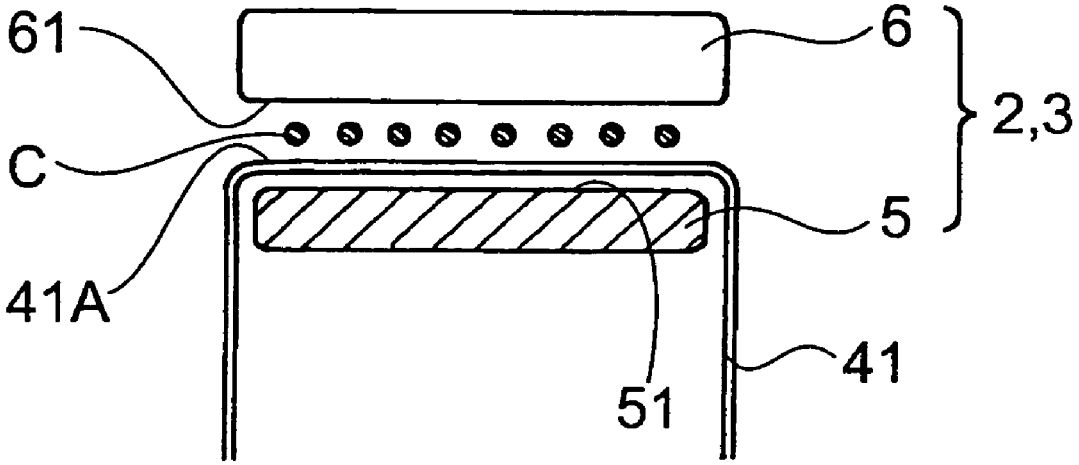
FIG. 7(*a*) and FIG. 7(*b*) are schematic cross-sectional views showing the positional relation between the heating head and the head receiving member in a mode of use of the mascara applicator of the first embodiment of the present invention, wherein FIG. 7(*a*) is a view showing a state in which the heating head and the head receiving member are separated from each other (corresponding to FIG. 6(*a*)), and FIG. 7(*b*) is a view showing a state in which the heating head and the head receiving member are brought into intimate contact with each other (corresponding to FIG. 6(*b*)).
Figure 7B:
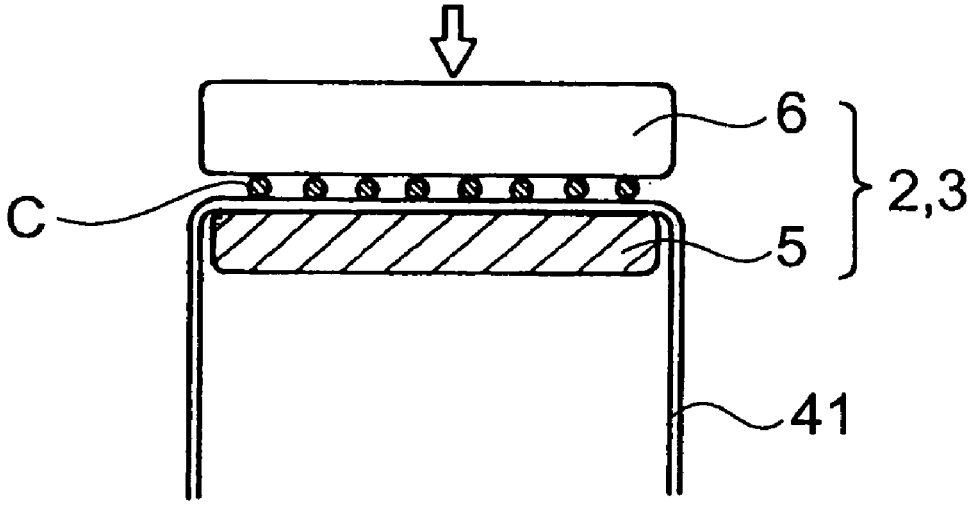

As shown in FIG. 1(*a*) to FIG. 7(*b*), a mascara applicator 1 of the first embodiment integrally has curling means 2 for holding eyelashes C to curl the eyelashes C (see FIG. 7(*a*) and FIG. 7(*b*)) into a certain shape, mascara adhering means 3 for adhering a mascara agent to the eyelashes C, and mascara supplying means 4 for supplying the mascara agent to the mascara adhering means 3. Also, the mascara adhering means 3 in the first embodiment serves as mascara transferring means for adhering the mascara agent to the eyelashes C by means of thermal transfer. Moreover, in the mascara applicator 1 of the first embodiment, the curling means 2 also serves as the mascara transferring means 3.

The mascara applicator 1 of the first embodiment will be described in detail. As shown in FIG. 1(*a*) to FIG. 7(*b*), the curling means 2 (which also serves as the mascara transferring means 3) has a heating head 5 having a heating surface 51 and a head receiving member 6 having an abutting surface 61 which has a shape conforming to the heating surface 51 of the heating head 5. Between the heating head 5 and the head receiving member 6, film-shaped mascara 41, to be described hereinbelow, is arranged, and a proper space is provided for holding the eyelashes C. Either the heating head 5 or the head receiving member 6 is movable in order to hold the eyelashes in the space therebetween. That is, the heating surface 51 of the heating head 5 and the abutting surface 61 of the head receiving member 6 are configured so as to be capable of being brought into intimate contact with each other and separated from each other.

In addition to the direct intimate contact of the heating surface of the heating head with the abutting surface of the head receiving member, the intimate contact of the heating surface with the abutting surface includes the indirect intimate contact of the heating surface with the abutting surface with the film-shaped mascara and the eyelashes intervening therebetween, as shown in FIG. 7(*a*) and FIG. 7(*b*). Moreover, as shown in FIG. 1(*a*) and FIG. 1(*b*), the mascara supplying means 4 is configured such that the mascara agent is supplied to the mascara transferring means 3 as the film-shaped mascara 41 having a long tape-like shape and having the mascara agent applied to the surface of a film material. Further, the mascara supplying means may have a mode in which an individual sheet of film-shaped mascara is used by loading it into the mascara applicator of the present invention for each single mascara application operation.

As shown in FIG. 7(*a*) and FIG. 7(*b*), the film-shaped mascara 41 is arranged between the heating head 5 and the head receiving member 6 and in the side of the heating surface 51 of the heating head 5 such that a mascara agent coated surface 41A is faced to the abutting surface 61 of the head receiving member 6, and the eyelashes C are inserted into a position between the coated surface 41A of the film-shaped mascara 41 and the abutting surface 61 of the head receiving member 6. The eyelashes C are then held between the heating surface 51 of the heating head 5 and the abutting surface 61 of the head receiving member 6 together with the film-shaped mascara 41. By heating the heating surface 51 of the heating head 5, the eyelashes C are curled between the heating surface 51 of the heating head 5 and the abutting surface 61 of the head receiving member 6 into a certain shape, and at the same time, the mascara agent on the film-shaped mascara 41 is thermally transferred to the eyelashes C.

Figure 3A:
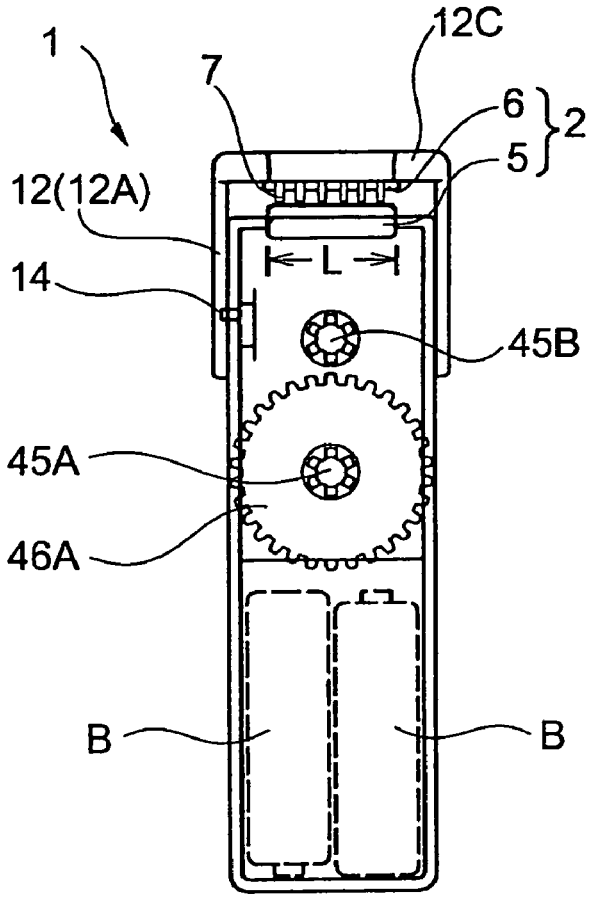
FIG. 3(*a*), FIG. 3(*b*), and FIG. 3(*c*) are views showing the mascara applicator of the first embodiment of the present invention in a state in which the film case is removed, wherein FIG. 3(*a*) is a front view, FIG. 3(*b*) is a right side view, and FIG. 3(*c*) is an enlarged side view of a heating head.
Figure 3B:
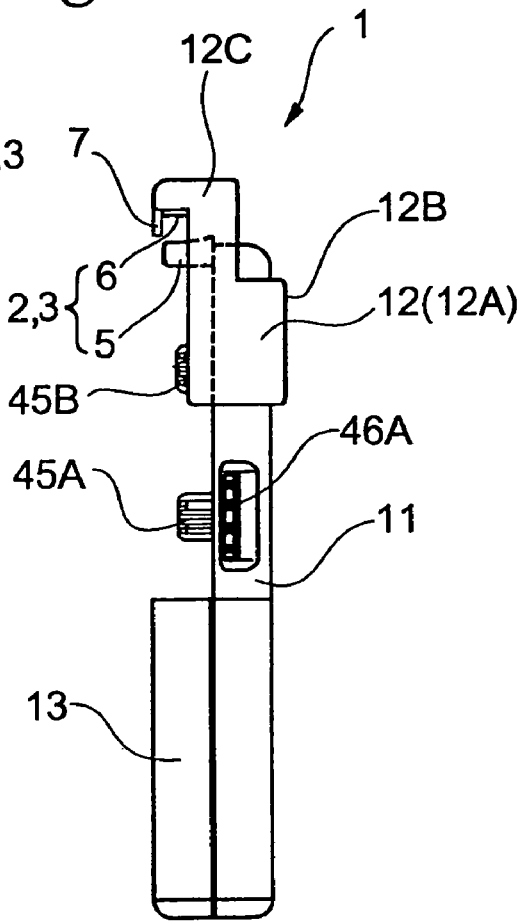
Figure 3C:
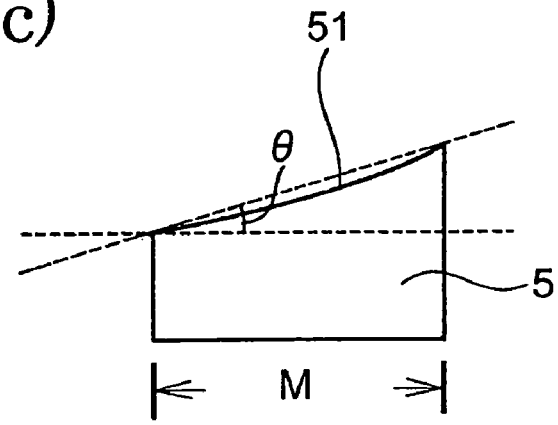

Further in detail, the mascara applicator 1 of the first embodiment has a nearly rectangular parallelepiped applicator body 11 and an arm member 12 which is provided to the top portion of the applicator body and is vertically movable, as shown in FIG. 1(*a*) to FIG. 3(*b*). As shown in FIG. 3(*a*), two dry batteries B serving as a power source for heating the heating surface 51 of the heating head 5 are attached to the lower half of the front surface (the left side in FIG. 3(*b*)) of the applicator body 11. A battery cover 13 for covering the dry batteries B is provided to the lower half of the front surface of the applicator body 11.

As shown in FIG. 1(*a*), FIG. 1(*b*), FIG. 3(*a*), and FIG. 3(*b*), the heating head 5 is provided to the upper part of the front surface of the applicator 11 so as to protrude forward. The heating head 5 is made entirely of metal and is heatable. Also, as shown in FIG. 3(*c*), the upper surface of the heating head 5 serves as the heating surface 51, and, as viewed from the side, the heating head 5 is smoothly inclined upwardly from the front surface to the rear surface of the applicator body 11. The inclination θ of the heating surface 51 of the heating head 5 (see FIG. 3(*c*)) is set in accordance with the desired curling shape as appropriate. In the first embodiment, the inclination θ is normally 10 degrees to 20 degrees. In addition, in the first embodiment, the heating head 5 as a whole can rotationally move to change the inclination of the heating surface 51 with respect to the applicator body 11, and thus the curling angle can be changed in accordance with the user's preference.

As shown in FIG. 1(*a*) to FIG. 3(*b*), the arm member 12 has side pieces 12A and 12A positioned on both sides of the upper part of the applicator body 11, a rear piece 12B positioned in the rear surface of the abovementioned upper part, and the upper piece 12C positioned on the upper surface of the applicator body 11 and above the heating head 5. A knob 12D for vertically moving the arm member 12 is formed in the rear piece 12B. The front edge of the upper piece 12C of the arm member 12 has a shape concave to the rear edge and conforming to the shape of the user's face (around eyebrows). As shown in FIG. 3(*a*) and FIG. 3(*b*), the head receiving member 6 is provided in the lower surface of the upper piece 12C.

Figure 4A:
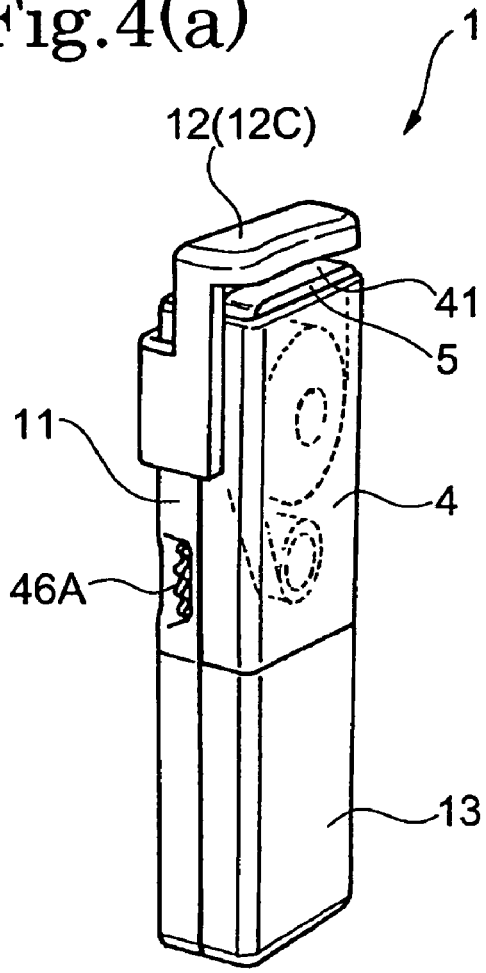
FIG. 4(*a*) and FIG. 4(*b*) are front perspective views showing the mascara applicator of the first embodiment of the present invention, wherein FIG. 4(*a*) is a view showing a state before use in which an arm member having a head receiving member provided thereto is arranged in an upper portion (the same as FIG. 1(*a*)), and FIG. 4(*b*) is a view showing a state in use in which the arm member is arranged in a lower portion.
Figure 4B:
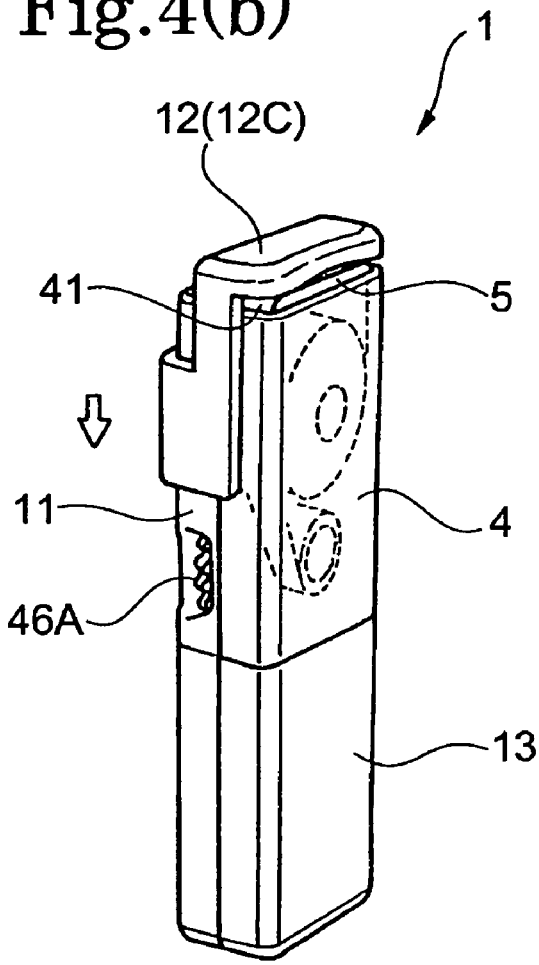

The arm member 12 is attached to the applicator body 11 and is vertically movable. When the arm member 12 is located at the uppermost position, the head receiving member 6 is apart from the heating head 5 as shown in FIG. 4(*a*). When the arm member 12 is located at the lowermost position, the abutting surface 61 of the head receiving member 6 is brought into intimate contact with the heating surface 51 of the heating head 5 as shown in FIG. 4(*b*). The head receiving member 6 is made of a synthetic resin, and the abutting surface 61 of the head receiving member 6 has a shape conforming to the inclined shape of the heating surface 51 of the heating head 5. As shown in FIG. 3(*a*) and FIG. 3(*b*), a comb member 7 formed of a plurality of comb teeth extending downward is provided in the front edge side of the lower surface of the upper piece 12C of the arm member 12, and thus a combing effect can be achieved on the eyelashes.

Further described are a preferred range of the length and the width of the heating head 5 and the head receiving member 6. Since the line of the eyelash roots has a gently curved shape as viewed from the top, the front end of each of the heating head 5 and the head receiving member 6 preferably has a curved shape conforming to the shape of the line of the eyelash roots. However, the film-shaped mascara 41 is difficult to be formed into a curved shape. In view of this, the front end shape of each of the heating head 5 and the head receiving member 6 is made linear.

Thus, if emphasis is placed on curling and applying mascara as beautiful as possible into a shape conforming to the shape of the line of the eyelash roots, a preferred design is that a plurality of partial operations are performed. In this case, the length (L in FIG. 3(*a*)) of the heating head 5 and the head receiving member 6 is smaller than the entire width of the line of the eyelash roots and is, for example, 10 mm to 15 mm. On the other hand, if emphasis is placed on completing curling and the application of mascara on one side of the eyelashes by a single operation, a preferred design is that the operation is applied to the entire width of the line of the eyelashes at a time. In this case, the length L of the heating head 5 and the head receiving member 6 is equal to or longer than the width of the line of the eyelash roots and is, for example, 30 mm to 40 mm. Also, the width in the depth direction (M in FIG. 3(*c*)) of the heating head 5 and the head receiving member 6 is preferably designed to be longer than the length of the eyelashes and is, for example, 10 mm to 15 mm.

A further description of the mascara supplying means 4 will be given. The mascara supplying means 4 has the film-shaped mascara 41 having a long tape form, a film case 42 accommodating the film-shaped mascara 41, and a pair of film reels 43A and 43B capable of winding the film-shaped mascara 41, and these members constitute a cartridge. As shown in FIG. 1(*a*) and FIG. 1(*b*), the cartridge can be removably attached to the front upper half of the applicator body 11 (above the battery cover 13). Preferably, the whole or a part of the film case 42 is transparent for enabling the remaining amount of the film-shaped mascara 41 to be visually checked.

The path of the film-shaped mascara 41 from the film reel 43A (the lower reel as viewed form the front) to the film reel 43B (the upper reel as viewed form the front) originates from the film reel 43A, as shown in FIG. 1(*b*), extends upward in the upper left direction from the film reel 43A, and turns to the upward vertical direction. Then the path extends from the upper surface 42A of the film case 42 to the outside of the film case 42, turns to the right direction, and turns to the downward vertical direction. Subsequently, the path enters from the outside of the film case 42 into the inside thereof, and reaches the film reel 43B.

As shown in FIG. 3(*a*), a gear-shaped knob 46A (illustrated by a solid line for convenience) is provided inside the upper half portion of the applicator body 11. As shown in FIG. 1(*a*) to FIG. 3(*b*), the gear-shaped knob 46A is exposed from both side edges of the applicator body 11 and can be rotated by a finger or the like. Preferably, the applicator body 11 has a size capable of being held by one hand. The rotational operation of the gear-shaped knob 46A can be carried out by use of a right hand finger as well as a left hand finger, and thus the traveling direction of the film-shaped mascara 41 can be designed in accordance with a convenient operational mode.

A pair of vertically separated reel driving shafts 45A and 45B are provided in the front upper half portion of the applicator body 11. The reel driving shaft 45A is coaxially connected to the gear-shaped knob 46A. Thus, as the gear-shaped knob 46A is rotated, the reel driving shaft 45A is rotated in the same direction. The reel driving shafts 45A and 45B can be inserted into and engaged with the film reels 43A and 43B, respectively. Thus, when the gear-shaped knob 46A rotates while the reel driving shafts 45A and 45B are inserted into and engaged with the film reels 43A and 43B, respectively, the film reel 43A is rotated in the same direction. Moreover, as the film reel 43A rotates, the film-shaped mascara 41 wound thereon travels, and the other film reel 43B is driven to rotate.

When the reel driving shafts 45A and 45B are inserted into the film reels 43A and 43B, respectively, to mount the film case 42 (the cartridge) on the applicator body 11, the heating head 5 is arranged between the upper surface 42A of the film case and the lower surface of the film-shaped mascara 41, as shown in FIG. 1(*a*) and FIG. 1(*b*). If the gear-shaped knob 46A is rotated in the left direction as viewed from the front while the film case 42 is attached to the applicator body 11, the film-shaped mascara 41 is unreeled from the upper film reel 43B side and wound by the lower film reel 43A side.

A switch 14 (illustrated by a solid line for convenience) is provided inside the front upper half portion of the applicator body 11, as shown in FIG. 3(*a*). The switch 14 vertically moves together with the vertical motion of the arm member 12. When the arm member 12 is brought down until the heating surface 51 of the heating head 5 is brought into intimate contact with the abutting surface 61 of the head receiving member 6, the heating of the heating head 5 is switched on. When the heating surface 51 of the heating head 5 is separated from the abutting surface 61 of the head receiving member 6, the heating is switched off. Therefore, in the mascara applicator 1 of the first embodiment, the heating of the heating head 5 is switched on while the eyelashes C are held between the heating surface 51 of the heating head 5 and the abutting surface 61 of the head receiving member 6 together with the film-shaped mascara 41 (see FIG. 7(*b*)), and the heating is switched off while the heating head 5 is separated from the head receiving member 6 (see FIG. 7(*a*)).

Figure 5:
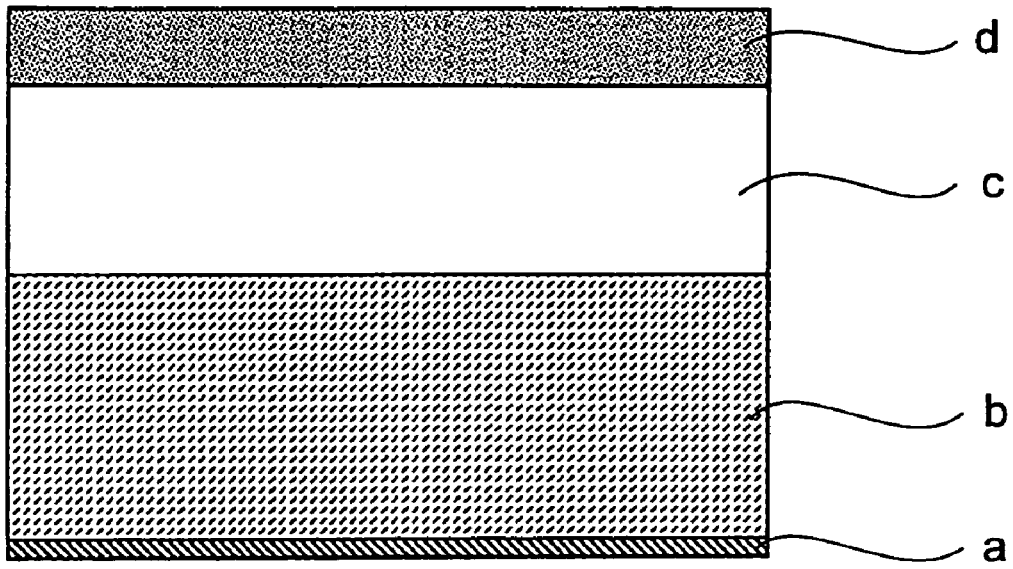
FIG. 5 is a schematic cross-sectional view showing a laminate structure of the film-shaped mascara in the mascara applicator of the first embodiment of the present invention.

The constitution of the film-shaped mascara 41 of the first embodiment will be described in detail. As shown in FIG. 5, the film-shaped mascara 41 is a four-layer laminate formed of a back coat layer a, a base film b, an underlayer c, and a mascara agent layer d laminated in this order from the bottom. When heat is applied to the back coat layer a side, melting and delamination occur mainly in the underlayer c, causing the mascara agent layer d together with a part of the underlayer c to be transferred to eyelashes.

The base film b is a base of the film-shaped mascara 41, and a material having high heat resistance and properties which are capable of exploiting the characteristics of the transferring layer is employed therefor. In this embodiment, polyethylene terephthalate (PET) having a thickness of 2.5 μm is employed.

As shown in FIG. 5, the back coat layer a is formed under the base film b and is a layer which abuts on the heating surface 51 of the heating head 5 during thermal transfer, and a material exhibiting high film strength and excellent heat resistance is employed therefor. In this embodiment, the back coat layer a is formed of a silicone modified butyral resin in an amount of 0.15 g/base film $m^2$.

As shown in FIG. 5, the underlayer c is an intervening layer between the base film b and the mascara agent layer d, and a material having film forming properties and low cohesion during heat melting is employed therefor. In this embodiment, the underlayer c is formed of a low molecular weight polyethylene wax and an ethylene-vinyl acetate copolymer in an amount of 1.3 g/base film $m^2$.

As shown in FIG. 5, the mascara agent layer d is formed on the underlayer c and is a layer to be thermally transferred to eyelashes. A material having excellent water resistance, adhesion properties, curl retention properties, and safety properties, in addition to film forming properties, tinting properties, and thermal responsiveness is employed therefor. In this embodiment, the mascara agent layer d is formed of an ethylene-vinyl acetate copolymer, a urethane modified lanolin wax, and an iron oxide in an amount of 1.0 to 1.3 g/$m^2$.

Preferably, the mascara agent in the film-shaped mascara contains a shape memory polymer. In this embodiment, the mascara agent contains a polyurethane shape memory polymer (product of POLYSIS Co.).

The description of the film-shaped mascara 41 will be given in more detail. The mascara agent composing the mascara agent layer d is thermally transferred to eyelashes as a coating layer adhering to the surface of the eyelashes so as to have a thickness of preferably 10 μm to 200 μm, more preferably 20 μm to 100 μm. For this purpose, the layer thickness of the mascara agent layer d before the thermal transfer is preferably 20 μm to 300 μm, more preferably 50 μm to 200 μm.

A part of the underlayer c (for example, 50 wt. % to 95 wt. %) is melted and delaminated and is thermally transferred to the eyelashes together with the mascara agent layer d so as to coat the mascara agent to a thickness of preferably 1 μm to 30 μm, more preferably 2 μm to 5 μm. For this purpose, the layer thickness of the underlayer c before the transfer is preferably 1 μm to 50 μm, more preferably 1 μm to 10 μm.

The film thickness of the base film b is preferably 1 μm to 100 μm, more preferably 2 μm to 50 μm.

The layer thickness of the back coat layer a is preferably 0.1 μm to 3 μm, more preferably 0.15 μm to 1 μm.

The film-shaped mascara of the mascara applicator of the present invention is not limited to the film-shaped mascara in the above embodiment.

Examples of the material for the base film b include synthetic polymer films such as polyethylene terephthalate, polyacrylonitrile, and polyethylene, and capacitor paper.

Examples of the material for forming the back coat layer a include silicone resin and fluorocarbon resin.

Examples of the material for forming the underlayer c include waxes such as paraffin wax, polyethylene wax, ester wax, carnauba wax, and montan wax, and resin materials such as polyvinyl acetate, ethylene-vinyl acetate copolymer, vinyl chloride-vinyl acetate copolymer, and polyvinyl alcohol.

Examples of the material for forming the mascara agent layer d include resin materials such as polyvinyl acetate, ethylene-vinyl acetate copolymer, vinyl chloride-vinyl acetate copolymer, polyvinyl alcohol, polystyrene, polyamide, acrylic resin, and petroleum resin, waxes such as paraffin wax, polyethylene wax, ester wax, carnauba wax, and montan wax, and coloring agents such as inorganic pigment, organic pigment, and dye. Examples of the shape memory polymer include polyurethane-based (Diary, product of Mitsubishi Heavy Industries, Ltd.), polyisoprene-based, styrene-butadiene-based, and polyethylene-based polymers.

Since the mascara agent layer d of the film-shaped mascara 41 is transferred to eyelashes by use of the mascara applicator 1 of the above embodiment, a preferred composition of the material for forming the mascara agent layer d is 0 parts by weight to 10 parts by weight of the above wax and 1 part by weight to 20 parts by weight of the above coloring agent with respect to 100 parts by weight of the above resin material.

Since a part of the underlayer c is transferred together with the mascara agent layer d to eyelashes, a preferred composition of the material for forming the underlayer c is 0 parts by weight to 20 parts by weight of the above resin material with respect to 100 parts by weight of the above wax.

Next, a preferred mode of use of the mascara applicator 1 of the first embodiment will be described with reference to FIG. 6(*a*), FIG. 6(*b*), FIG. 7(*a*), and FIG. 7(*b*). In the mascara applicator 1 of the first embodiment, the film case 42 (the cartridge) is attached to the applicator body 11 if the film case 42 is not attached to the applicator body 11. If the film-shaped mascara 41 disposed above the upper surface 42A of the film case 42 has already been used, the gear-shaped knob 46A is rotated to dispose the unused film-shaped mascara 41 above the upper surface 42A of the film case 42.

Figure 6A:
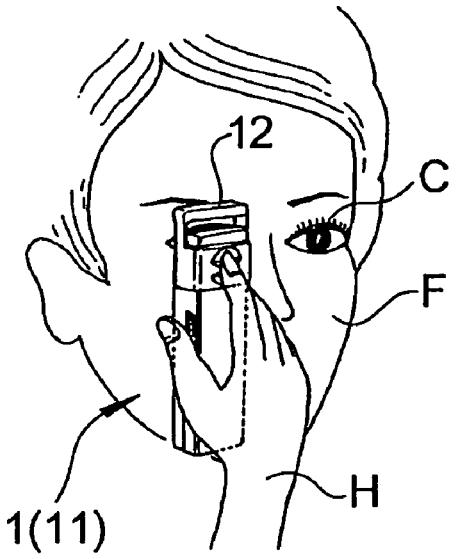
FIG. 6(*a*) and FIG. 6(*b*) are views showing a mode of use of the mascara applicator of the first embodiment of the present invention, wherein FIG. 6(*a*) is a view showing a state in which eyelashes are inserted between the heating head (the film-shaped mascara) and the head receiving member while the arm member is arranged in the upper portion, and FIG. 6(*b*) is a view showing a state in which the arm member is arranged in the lower portion to hold the eyelashes between the heating head and the head receiving member.
Figure 6B:
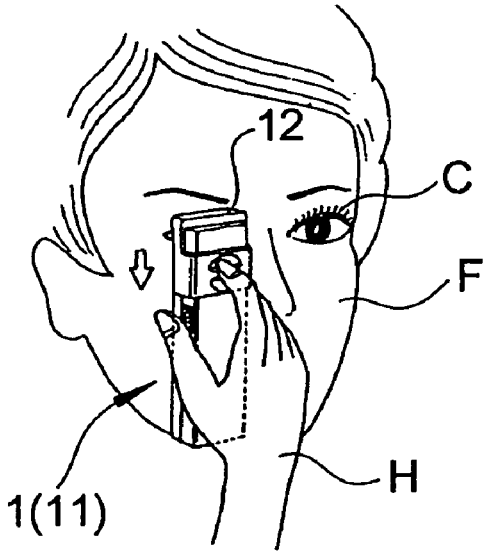

In the state in which the unused film-shaped mascara 41 is disposed above the upper surface 42A of the film case 42, the applicator body 11 of the mascara applicator 1 of the first embodiment is held by a hand H as shown in FIG. 6(*a*), and the eyelashes C are disposed between the mascara agent coated surface 41A of the film shaped mascara 41 and the abutting surface 61 of the head receiving member 6 provided in the lower surface of the upper piece 12C of the arm member 12 as shown in FIG. 7(*a*). While maintaining this state, a forefinger, for example, is placed on the knob 12D of the arm member 12 to bring down the arm member 12 as shown in FIG. 6(*b*), and the eyelashes C are held between the heating surface 51 of the heating head 5 and the abutting surface 61 of the head receiving member 6 together with the film-shaped mascara 41 as shown in FIG. 7(*b*). At this time, the eyelashes C are curled between the heating surface 51 of the heating head 5 and the abutting surface 61 of the head receiving member 6 into a certain shape. Simultaneously, the switch 14 moves downward, and the heating of the heating head 5 is switched on to heat the heating surface 51. Therefore, the curling shape of the eyelashes is fixed, and the mascara agent layer d of the film-shaped mascara 41 is thermally transferred to the eyelashes C.

As described above, according to the mascara applicator 1 of the first embodiment, the eyelashes C are curled between the heating surface 51 of the heating head 5 and the abutting surface 61 of the head receiving member 6 into a certain shape only by bringing down the arm member 12. At the same time, the mascara agent in the film-shaped mascara 41 is thermally transferred to the eyelashes C. At this time, the mascara agent adheres uniformly to the eyelashes C without damaging the eyelashes. Thus, according to the mascara applicator 1 of the first embodiment, the curling of the eyelashes and the application of the mascara agent to the eyelashes can be performed easily and simultaneously. In addition, the mascara agent applied to the eyelashes is smear-proof and clump-free, and has a long lasting curling effect.

In addition, according to the mascara applicator 1 of the first embodiment, particularly since the film-shaped mascara 41 having a long length is continuously supplied, the fresh coated surface 41A can be exposed by shifting the position of the film-shaped mascara 41, thereby providing convenience. On the other hand, a mode in which a one-time disposable sheet is used as the film-shaped mascara may be employed. In this case, the mechanism for loading the tape-shaped long film is not required, and thus the constitution of the applicator becomes simpler.

If a material containing a shape memory polymer is employed as the mascara agent, the retention of the curling shape of eyelashes is particularly facilitated. The eyelashes C having the mascara agent transferred thereto are brushed with the comb member 7, allowing the eyelashes to be separated one by one. At the same time, the mascara agent in a melted state is spread to make the shape of the eyelashes after the mascara application beautiful. Moreover, the heating of the heating head 5 is switched on simply by lowering the arm member 12, providing an easy operation.

Figure 8:
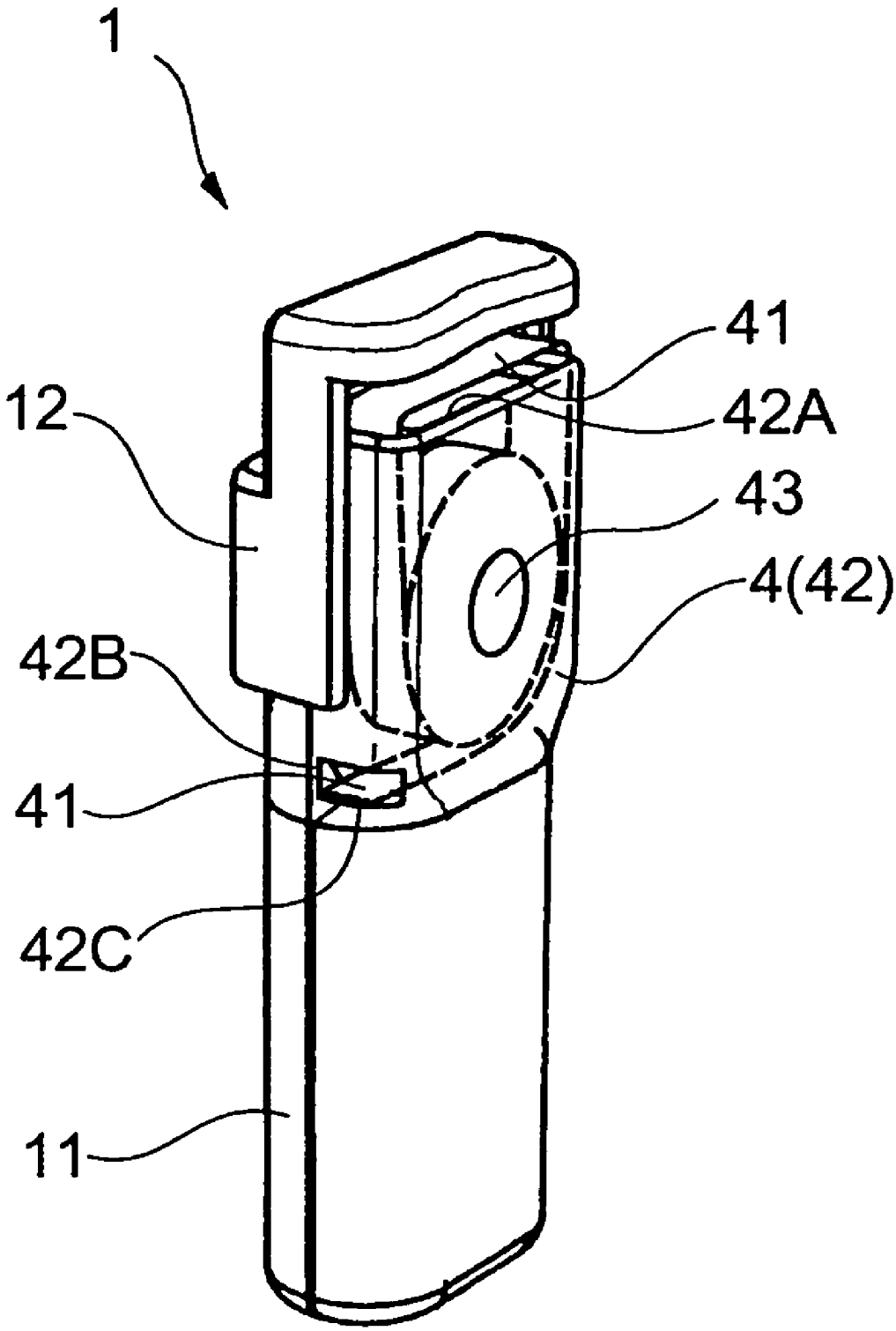
FIG. 8 is a front perspective view showing a mascara applicator of another embodiment (a second embodiment) of the present invention.

Next, a second embodiment different from the first embodiment shown in FIG. 1(*a*) to FIG. 7(*b*) will be described with reference to FIG. 8. In the description of the second embodiment, the differences from the first embodiment will mainly be described. When a description is not given, the description of the first embodiment will be applied as appropriate. The principal difference of a mascara applicator 1 of the second embodiment from the mascara applicator 1 of the first embodiment is the constitution of the mascara supplying means 4.

In the mascara supplying means 4 of the mascara applicator 1 of the second embodiment, one film reel 43 for winding the film-shaped mascara 41 is provided in a film cassette 42. As shown in FIG. 8, the path of the film-shaped mascara 41, as viewed from the front, originates from the film reel 43 and extends upward therefrom. The path then extends from an upper surface 42A of the film case 42 to the outside, turns to the right direction, and turns downward, enters from the outside of the film case 42 into the inside thereof. The path then gradually turns to the left direction so as not to contact with the film-shaped mascara 41 wound on the film reel 43, and is ejected from an film outlet 42B provided in the lower portion of the left side surface of the film case 42.

A sawtooth-shaped film cutting edge 42C is provided in the proximity of the film outlet 42B, allowing the film-shaped mascara 41 ejected from the film outlet 42B to be cut. An adhesive is provided in the region between the film outlet 42B and the film cutting edge 42C. Thus, the end portion of the film-shaped mascara 41 cut by the film cutting edge 42C adheres to the adhesive for preventing the end portion from being drawn back into the film case 42. The other constitution is the same as that of the mascara applicator of the first embodiment. In order to move the film-shaped mascara 41, one end portion thereof is drawn out from the film outlet 42B of the film case 42 and is cut by the film cutting edge 42C.

The mascara applicator 1 of the second embodiment can be used in the same mode of use as that of the mascara applicator of the first embodiment, and thus the same effects can be attained. In addition, according to the mascara applicator 1 of the second embodiment, the numbers of the film reels and the reel driving shafts can be reduced as compared with those of the mascara applicator of the first embodiment, and thus cost reduction and size reduction (the reduction of the height) of the mascara applicator can be achieved.

Figure 9A:
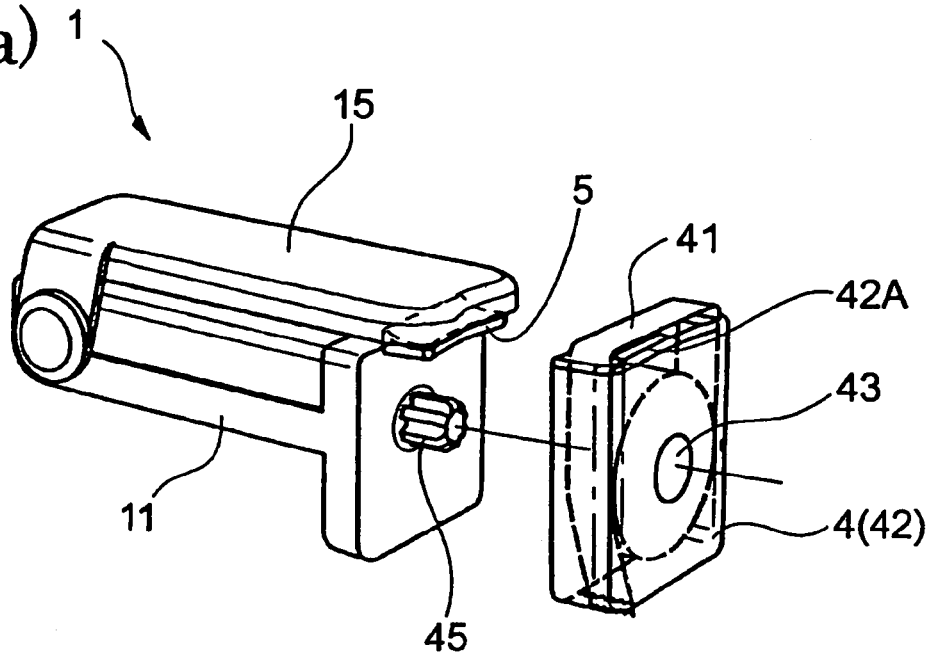
FIG. 9(*a*) and FIG. 9(*b*) are front perspective views showing a mascara applicator of further embodiment (a third embodiment) of the present invention, wherein FIG. 9(*a*) is a view showing a state in which a film case is removed, and FIG. 9(*b*) is a view showing a state in which the film case is attached and a rotating arm member is rotationally moved upward.
Figure 9B:
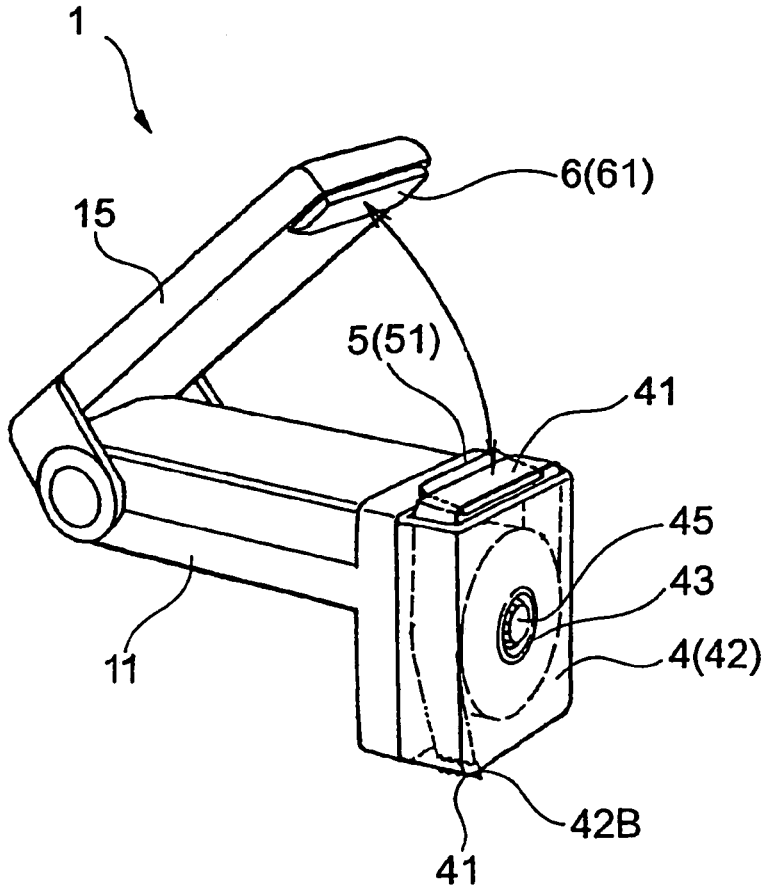

Next, a third embodiment of the mascara applicator of the present invention will be described with reference to FIG. 9(*a*) and FIG. 9(*b*). In the description of the third embodiment, the differences from the second embodiment will mainly be described. When a description is not given, the description of the second embodiment will be applied as appropriate. As shown in FIG. 9(*a*) and FIG. 9(*b*), the constitution of a mascara applicator 1 of the third embodiment is the same as that of the mascara applicator 1 of the second embodiment, except that the positional relation between the applicator body 11 and the mascara supplying means 4 is different.

Therefore, the applicator body 11 of the mascara applicator 1 of the third embodiment has a form extending from the front to the rear as viewed from the front, and the height of the mascara applicator 1 as a whole is nearly the same as the height of a film case 42, resulting in a constitution in which the size is reduced in the height direction. Moreover, in the front upper portion of the applicator body 11, a heating head 5 is provided toward the front. As in the second embodiment, dry batteries (not shown) for heating a heating surface 51 of the heating head 5 are accommodated inside the applicator body 11.

A rotating arm member 15 is provided above the applicator body 11 so as to cover the top surface of the applicator body 11. A head receiving member 6 is provided in the front end side of the lower surface of the rotating arm member 15, and the rear end side of the rotating arm member 15 is rotatably connected to the rear end of the applicator body 11. When the rotating arm member 15 is rotationally moved upward, the head receiving member 6 provided in the rotating arm member 15 is separated from the heating head 5 provided in the applicator body 11, as shown in FIG. 9(*b*). When the rotating arm member 15 is rotationally moved downward, the heating head 5 is brought into intimate contact with the head receiving member 6, as shown in FIG. 9(*a*). In addition, when the rotating arm member 15 is rotationally moved downward such that the heating head 5 is brought into intimate contact with the head receiving member 6, the heating of the heating head 5 is switched on. When the rotating arm member 15 is rotationally moved upward to separate the heating head 5 from the head receiving member 6, the heating of the heating head 5 is switched off.

A mode of use of the mascara applicator 1 of the third embodiment will be described. First, the rotating arm member 15 is rotationally moved upward to separate the heating head 5 from the head receiving member 6. Subsequently, the film case 42 (the cartridge) is attached to the applicator body 11, and the unused film-shaped mascara 41 is arranged above the heating head 5. While maintaining this state, the film-shaped mascara 41 is arranged under eyelashes by holding the applicator body 11 by hand and bringing the applicator body 11 close to a user's eye. The rotating arm member 15 is then rotationally moved downward to hold the eyelashes together with the film-shaped mascara 41 between the heating surface 51 of the heating head 5 and the abutting surface 61 of the head receiving member 6. At this time, the eyelashes are curled between the heating surface 51 of the heating head 5 and the abutting surface 61 of the head receiving member 6 into a certain shape. At the same time, the heating of the heating head 5 is switched on to heat the heating surface 51 of the heating head 5. Therefore, the curling shape of the eyelashes is fixed, and the mascara agent of the film-shaped mascara 41 is melted and thermally transferred to the eyelashes.

The mascara applicator of the present invention is not limited to the above embodiments and the modes of use thereof, and modifications may be made as appropriate so long as they do not depart from the scope of the present invention.

Any mascara applicator may be employed as the mascara applicator of the present invention, so long as the applicator integrally has the curling means for holding eyelashes to curl the eyelashes into a certain shape, the mascara adhering means for adhering a mascara agent to the eyelashes, and the mascara supplying means for supplying the mascara agent to the mascara adhering means. As the above mascara adhering means, means for adhering, for example, by means of an ink jet method, laser method, or other method, a mascara agent prepared as ink, toner, or the like may be employed in addition to the above mascara transferring means, so long as the means can adhere a mascara agent to eyelashes. The curling means does not necessarily serve also as the mascara transferring means.

In the mascara supplying means, a manner for supplying the mascara agent to the mascara adhering means is not required to be a manner in which film-shaped mascara having a long tape form is continuously supplied. For example, a separate film of the above described mode may be employed by loading for each use a sheet of the film into the mascara applicator of the present invention. Various constitutions may be employed as the constitution in which the heating head and the head receiving member are capable of being brought into intimate contact with each other and separated from each other.

The above embodiments are configured such that the heating of the heating head is switched on when the heating head and the head receiving member are brought into intimate contact with each other. However, a constitution in which the heating head can be preheated before the heating head and the head receiving member are brought into intimate contact with each other may be employed. According to the curling means (which also serves as the mascara transferring means) configured as above, the heating head can be heated before eyelashes are held between the heating head and the head receiving member, and the eyelashes can be held between the heating head and the head receiving member while maintaining the above state.

In the mascara supplying means of the second and third embodiments, the adhesive is employed for preventing the film-shaped mascara from being drawn back into the case. However, in place of the adhesive, a pair of rolls holding one end portion of the film-shaped mascara therebetween may be provided inside the film case as means for preventing the drawing back. If this constitution is employed, the pair of rolls may be configured so as to rotate, upon rotating a knob or the like, in a direction where the film-shaped mascara is ejected. The principle of the mascara applicator of the present invention may be employed for transferring hair manicure to hair and for transferring manicure to a nail.

INDUSTRIAL APPLICABILITY

According to the mascara applicator of the present invention, the curling of eyelashes and the application of mascara to the eyelashes can be performed easily and simultaneously. In addition, the mascara agent applied to the eyelashes is smear-proof and clump-free, and has a long lasting curling effect.

The invention claimed is:

1. A mascara applicator integrally comprising:

curling means for holding eyelashes to curl the eyelashes into a certain shape;

mascara adhering means for adhering a mascara agent to the eyelashes, wherein said mascara adhering means serves as mascara transferring means for adhering the mascara agent to the eyelashes by means of thermal transfer; and mascara supplying means for supplying the mascara agent to the mascara adhering means, wherein said mascara supplying means supplies to said mascara transferring means a film-shaped mascara having the mascara agent applied on a surface of a film material.

2. The mascara applicator as claimed in claim 1, wherein said mascara transferring means comprises a heating head having a heating surface and a head receiving member having an abutting surface which has a shape conforming to said heating surface of said heating head, wherein said heating surface of said heating head and said abutting surface of said head receiving member are configured so as to be capable of being brought into intimate contact with each other and separated from each other, and wherein while disposing said film-shaped mascara between said heating head and said head receiving member and in the side of said heating surface of the heating head and while a coated surface of the film-shaped mascara is faced to said abutting surface of the head receiving member, the eyelashes are disposed between said coated surface of said film-shaped mascara and said abutting surface of said head receiving member, and the eyelashes are held together with said film-shaped mascara between said heating surface of said heating head and said abutting surface of said head receiving member, and said heating surface of said heating head is heated, thereby curling the eyelashes between said heating surface of said heating head and said abutting surface of said head receiving member into a certain shape and, at the same time, thermally transferring the mascara agent of said film-shaped mascara to the eyelashes.

3. The mascara applicator according to claim 2, wherein the heating of said heating head is switched on in a state in which the eyelashes are held between said heating surface of the heating head and said abutting surface of said head receiving member together with said film-shaped mascara, and wherein the heating of said heating head is switched off in a state in which said heating head is separated from said head receiving member.

4. The mascara applicator as claimed in claim 3, wherein said mascara supplying means continuously supplies, between said heating head and said head receiving member, said film-shaped mascara having a long tape form.

5. The mascara applicator according to claim 3, wherein said mascara supplying means loads, between said heating head and said head receiving member, said film-shaped mascara having an individual sheet form.

6. The mascara applicator according to claim 3, wherein said mascara agent contains a shape memory polymer.

7. The mascara applicator as claimed in claim 2, wherein said mascara supplying means continuously supplies, between said heating head and said head receiving member, said film-shaped mascara having a long tape form.

8. The mascara applicator according to claim 2, wherein said mascara supplying means loads, between said heating head and said head receiving member, said film-shaped mascara having an individual sheet form.

9. The mascara applicator according to claim 2, wherein said mascara agent contains a shape memory polymer.

10. The mascara applicator as claimed in claim 1, wherein said mascara supplying means continuously supplies, between said heating head and said head receiving member, said film-shaped mascara having a long tape form.

11. The mascara applicator according to claim 10, wherein said mascara agent contains a shape memory polymer.

12. The mascara applicator according to claim 1, wherein said mascara supplying means loads, between said heating head and said head receiving member, said film-shaped mascara having an individual sheet form.

13. The mascara applicator according to claim 12, wherein said mascara agent contains a shape memory polymer.

14. The mascara applicator according to claim 1, wherein said mascara agent contains a shape memory polymer.

* * * * *

UNITED STATES PATENT AND TRADEMARK OFFICE

CERTIFICATE OF CORRECTION

PATENT NO. : 7,640,938 B2
APPLICATION NO. : 10/553988
DATED : January 5, 2010
INVENTOR(S) : Okajima et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 804 days.

Signed and Sealed this

Sixteenth Day of November, 2010

David J. Kappos

David J. Kappos
*Director of the United States Patent and Trademark Office*